US006874342B1

(12) United States Patent
Batista

(10) Patent No.: US 6,874,342 B1
(45) Date of Patent: Apr. 5, 2005

(54) THREE-SET KEY ORGANIZER

(76) Inventor: Fausto Antonio Batista, 138-53 Lloyd Rd., Jamaica, NY (US) 11435

( * ) Notice: Subject to any disclaimer, the term of this patent is extended or adjusted under 35 U.S.C. 154(b) by 0 days.

(21) Appl. No.: 10/848,863

(22) Filed: May 20, 2004

(51) Int. Cl.[7] ..... A44B 15/00
(52) U.S. Cl. ..... 70/456 R; 70/456 B; 70/457
(58) Field of Search ..... 70/456 R–457, 70/456 B; D3/207–212; 206/37.1, 38.1; 24/3.6

(56) References Cited

U.S. PATENT DOCUMENTS 1,543,054 A * 6/1925 Bushnell ..... 206/37.5
1,579,017 A * 3/1926 Marymont ..... 206/37.6
2,322,645 A * 6/1943 Jones ..... 70/456 R
2,342,079 A * 2/1944 Jones ..... 70/456 R
2,479,524 A * 8/1949 Tarbox ..... 206/37.4
2,602,320 A * 7/1952 Lane ..... 70/456 B
2,978,897 A * 4/1961 Capitani ..... 70/456 R
3,119,429 A * 1/1964 Stiller et al. ..... 206/37.3
3,280,967 A * 10/1966 Bergh et al. ..... 70/456 R
3,294,136 A * 12/1966 Cain et al. ..... 150/106
3,442,103 A * 5/1969 Le Page ..... 70/456 R
3,524,336 A * 8/1970 Crosby et al. ..... 70/457
4,799,587 A * 1/1989 Desanto ..... 206/37.6
5,884,514 A * 3/1999 Willis ..... 70/456 R
5,934,123 A * 8/1999 Eldredge ..... 70/456 R
6,684,673 B2 * 2/2004 Florendo ..... 70/456 R

* cited by examiner

*Primary Examiner*—Suzanne Dino Barrett

(57) ABSTRACT

A pouch made of fabric (#5) for storing keys, with three separate detachable devices (#1), (#2), (#3), made of rigid material. Below each device, an L shaped rod made of rigid material (#9), where the bow of the keys hang. Each rod has a detachable cap (#8), to secure the keys within each rod. Each device comes with notches (#7) that are made of flexible material, so that it can be repeatedly bent without fracturing, parallel to each side of the device. Each notch aligns with the proper slots (#6) on the lip, made of rigid material (#4) when pressed simultaneously within the slots the device will release from the pouch unit.

1 Claim, 6 Drawing Sheets

THREE-SET KEY ORGANIZER
LEFT SET KEY HOLDER

THREE-SET KEY ORGANIZER
MIDDLE SET KEY HOLDER

THREE-SET KEY ORGANIZER
RIGHT SET KEY HOLDER

RIGHT KEY HOLDER

MIDDLE KEY HOLDER

LEFT KEY HOLDER

THREE-SET KEY ORGANIZER

The three-set key organizer allows the user to organize his or hers home, work and car keys and access them in a quick and efficient manner.

DESCRIPTION OF THE DRAWINGS

PAGE 1 in FIGS. 1A and 1B, numerals # 1, 2, 3, left, middle and right, detachable key holders, made of stone grey thermoplastic polyurethane (TPU). Each key holder has two oval shape notches, as shown in page 2 FIGS. 2A and 2B numeral #7, one facing the front and the other parallel facing the back align with the appropriate slot on the rigid plastic lip made of thermoplastic polyurethane (TPU). Each notch is made to be flexible, and able to bend inward when attaching the key holder to the rigid lip, of the sheath or key housing. By pressing the two notches simultaneous inward, the key holder is able to detach from the rigid lip of the sheath or key housing. Each key holder has one shank made of stainless steel metal, page 2 FIG. 2B, numeral # 9 where the bow of the key hangs. Each shank comes with a screw on cap nut, made of stainless steel metal, page 2 FIG. 2B numeral #8. The cap nut purpose is to secure keys with in each shank. Page 1 fig 1B numeral #4 rigid plastic lip, made of thermoplastic polyurethane (TPU), contains six slots for the key holders, three on the front and three parallel on the back. Page 6 FIG. 6A also show the align slots on the rigid plastic lip. This rigid lip also is the main frame that attach to the pouch that made of jacquard fabric. Page 1 FIG. 1A and 1B, numeral #5 sheath, key housing, a pouch, made of jacquard fabric, attached to the upper lip, made to covers all keys. Page 1 FIG. 1B numeral #6 slots: six narrow groove, three on the front and three on the back of the rigid plastic lip as also shown in page 6

Reference Numerals

#1 left key holder
#2 middle key holder
#3 right key holder
#4 rigid plastic lip
#5 sheath, key housing
#6 slot
#7 notch
#8 cap nut
#9 shank.

DRAWINGS

Figure 1C:
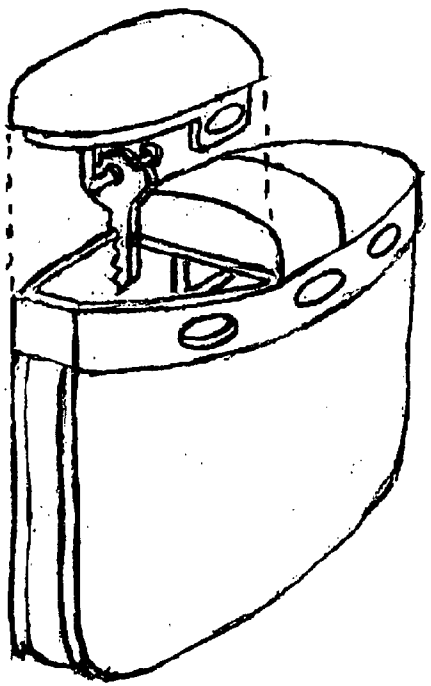
Figure 1B:
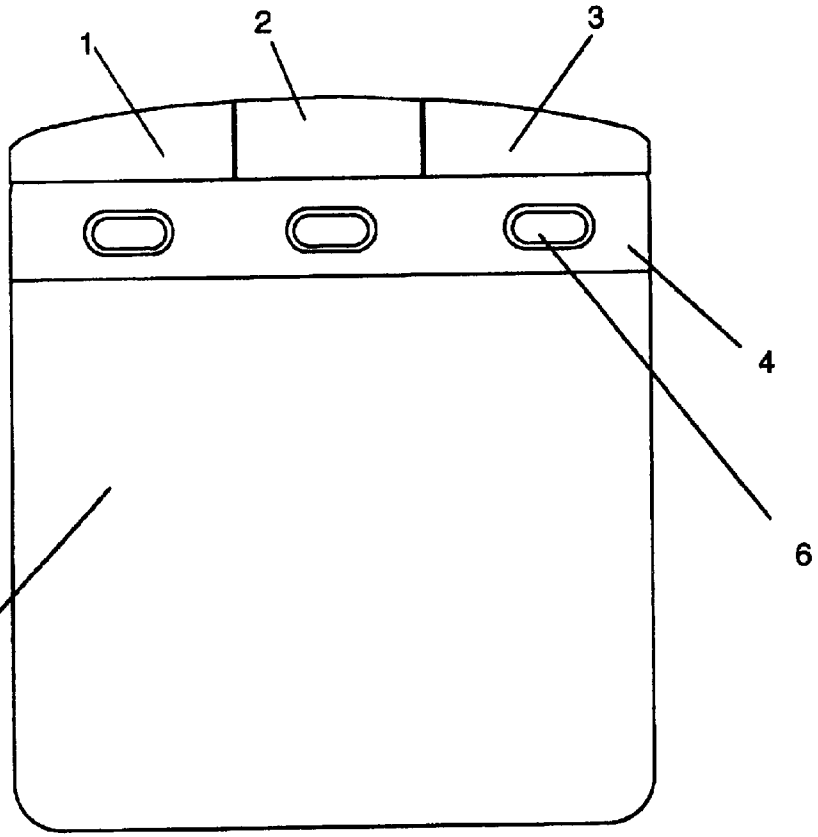
Figure 1A:
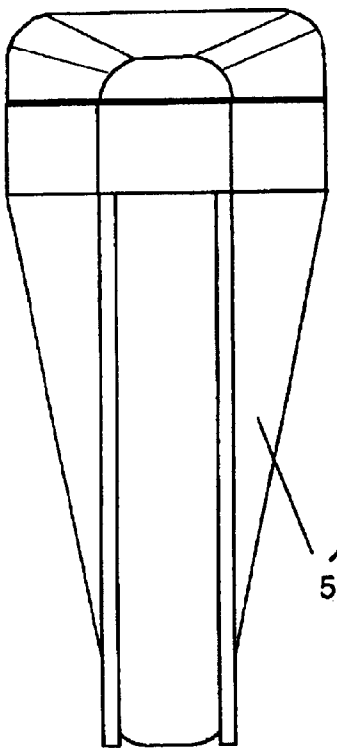

Page 1, three views of the three-set key organizer, FIG. 1A side view of the three-set key organizer, FIG. 1B front view of the three-set key organizer, with all part in numerals. FIG. 1C a three dimensional view of the three-set key organizer with the left key holder raise up with key display on the shank part of the holder illustrating how the keys are store in the organizer.

Figure 2D:
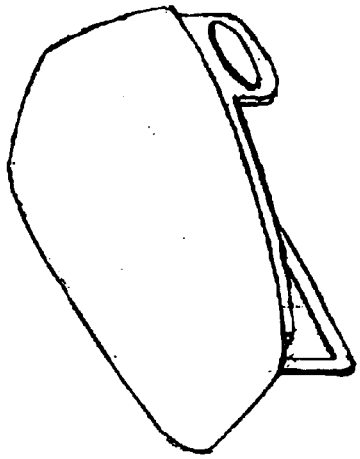
Figure 2C:
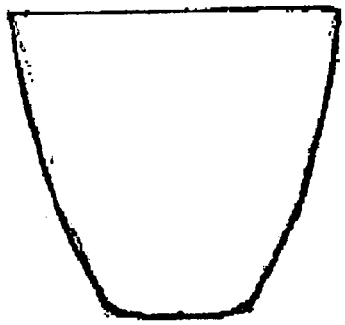
Figure 2B:
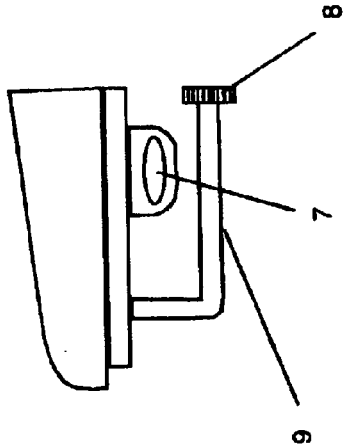
Figure 2A:
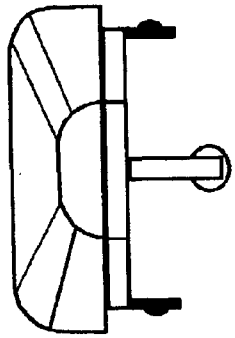

Page 2, four views of the left key holder, FIG. 2A side view, FIG. 2B front view, FIG. 2C top view and FIG. 2D three-dimensional view.

Figure 3D:
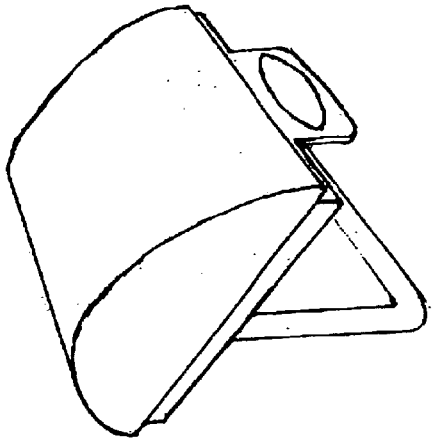
Figure 3C:
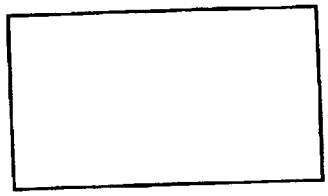
Figure 3B:
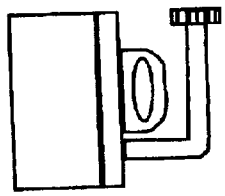
Figure 3A:
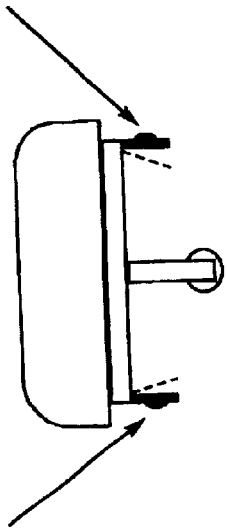

Page 3, four views of the middle key holder, FIG. 3A side view, with two arrows and broken lines behind each notch illustrating the inward bend each key holder, notches can do. FIG. 3B front view, FIG. 3C top view, and FIG. 3D three-dimensional view.

Figure 4D:
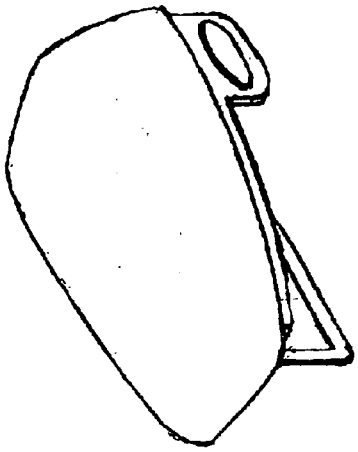
Figure 4C:
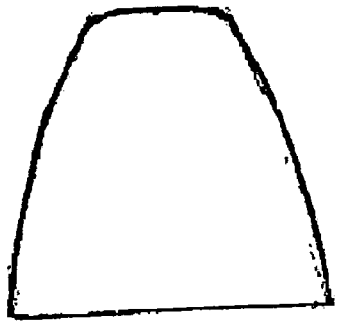
Figure 4B:
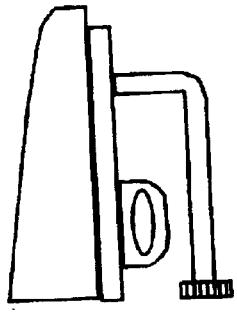
Figure 4A:
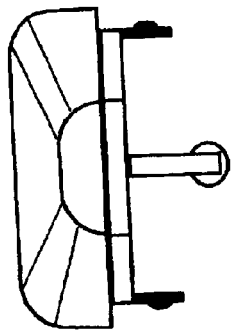

Page 4, four views of the right key holder, FIG. 4A side view, FIG. 4B front view, FIG. 4C top view, and FIG. 4D three-dimensional view.

Figure 5C:
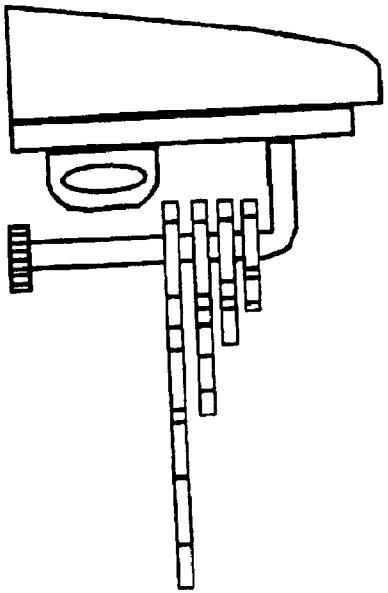
Figure 5B:
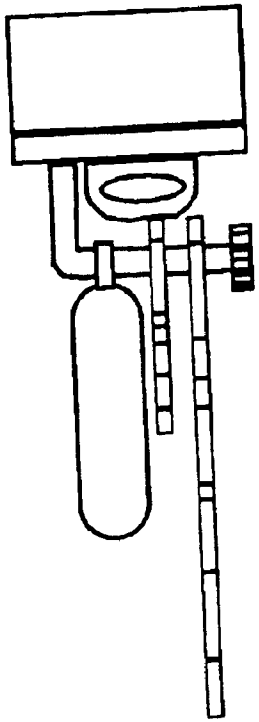
Figure 5A:
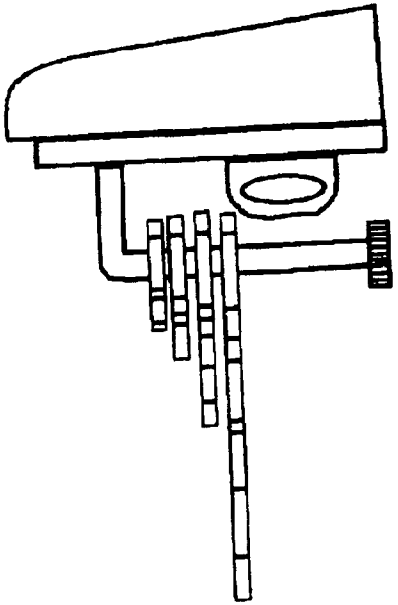

Page 5 A front view of all three key holder display with different set of keys in a organize category. FIG. 5A left key holder with home keys. FIG. 5B middle key holder with car key, and alarm pager. FIG. 5C right key holder with work keys.

Figure 6A:
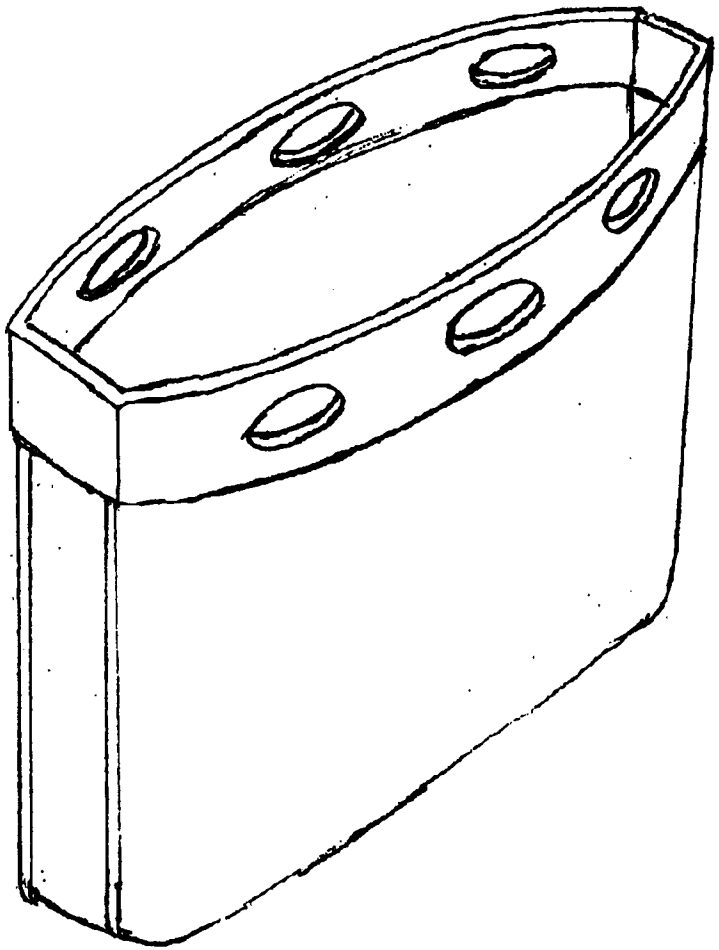
FIG. 6A, is the locking method use for each key holders, which has a oval shape notch, flexible when bent inward, that fits in place of each narrow groove on the rigid plastic lip as show in page 2 FIG. 2B numeral #7. Page 2 FIGS. 2A and 2B numeral #7 oval shape notches, two on each key holder, one facing the front and the other parallel facing the back align with the appropriate slot on the rigid plastic lip, made of thermoplastic polyurethane (TPU). Each notch is made to be flexible, and able to bend inward when attaching or detaching the key holder to the rigid lip's slots, of the sheath or key housing. Page 2 FIG. 2B numeral #8 cap nut made of stainless steel metal, screw on to the shank part of each key holder, to secure keys with in each shank. Page 2 FIG. 2B numeral #9 shank: made of stainless stain metal, where the bow of the key hangs.

Page 6 FIG. 6A, a three dimensional view of the sheath, key housing and rigid lip with the six slots, three in the front, and three in the back. This drawing is to show how the slot are align, to better understand the locking method use for these key holders, detachable from it's sheath, or key housing.

Feature Description

The three-set key organizer solves the need for people who have many keys and sometimes carry more than one key chain to help find keys more quickly. The Three-set key organizer will be compact and made of thermoplastic polyurethane (TPU), and jacquard fabric. It will allow the user easy and quick access to their home, work and car keys. The upper part of the pouch will have 3 separate key holders that are detachable after pressing a plastic button within the slots.

What is claimed is:

1. A key holder and key storage bag, comprising:

a bag comprised of fabric and having an open top portion with a periphery, a rigid plastic frame attached to the top periphery and comprising six grooves disposed around the periphery of the frame;

three detachable rigid plastic cover member key holders each comprising two flexible plastic tabs extending therefrom and disposed opposite each other on a periphery thereof to mount to the top frame by interlocking with the grooves correspondingly disposed on the periphery of the bag top frame, such that when all three covers are mounted to the top frame, the open top portion of the bag is covered by the three adjacently mounted cover members;

each cover member further comprising a rod member extending from a bottom surface of the cover to receive hanging keys and a nut mounted to the end of the rod to secure the keys thereon;

wherein keys may be secured to each cover member and stored within the bag by interlocking the cover member flexible tabs with the bag frame grooves to mount the cover to the bag and, wherein the keys may be accessed by bending the flexible tabs out of interlocking engagement with the grooves to release the cover member key holder and utilize the keys.

* * * * *